US005623273A

United States Patent [19]

Asai

[11] Patent Number: 5,623,273

[45] Date of Patent: Apr. 22, 1997

[54] WEEK-DAY AND/OR TIME DISPLAY SYSTEM FOR A DATA DISPLAY RADIO PAGER

[75] Inventor: Takayuki Asai, Tokyo, Japan

[73] Assignee: NEC Corporation, Tokyo, Japan

[21] Appl. No.: 353,155

[22] Filed: Dec. 9, 1994

Related U.S. Application Data

[63] Continuation of Ser. No. 827,391, Jan. 29, 1992, abandoned.

[30] Foreign Application Priority Data

Jan. 30, 1991 [JP] Japan ..... 3-010041

[51] Int. Cl.[6] ..... G09G 3/00

[52] U.S. Cl. ..... 345/33; 340/825.44; 368/241; 345/46

[58] Field of Search ..... 340/825.44, 311.1, 340/815.45; 455/38.4, 158.2; 368/82, 83, 84, 241, 242, 29, 30; 313/498, 500, 501, 506, 510, 513, 515, 516, 521, 517; 345/33, 34, 43, 44, 46

[56] References Cited

U.S. PATENT DOCUMENTS

| | | | |
|---|---|---|---|
| Re. 29,727 | 8/1978 | Fujita | 340/765 |
| 3,573,532 | 4/1971 | Boucher | 313/510 |
| 3,621,332 | 11/1971 | Janning | 313/521 |
| 3,971,012 | 7/1976 | Morokawa et al. | 368/242 |
| 4,019,196 | 4/1977 | Teshima et al. | 313/500 |
| 4,092,638 | 5/1978 | Ripley | 340/762 |
| 4,256,376 | 3/1981 | Kobayashi et al. | 340/765 |
| 4,271,497 | 6/1981 | Terzian | 345/34 |
| 4,872,005 | 10/1989 | DeLuca et al. | 340/825.44 |

FOREIGN PATENT DOCUMENTS

| | | |
|---|---|---|
| 1043243 | 11/1953 | France . |
| 52-027667 | 3/1977 | Japan . |
| 2038513 | 7/1980 | United Kingdom . |

OTHER PUBLICATIONS

WESCON Technical Paper, vol. 19, No. 19, 16 Sep. 1975, North Hollywood, pp. 1–4, J. Kerins, "CMOS Circuit for Digital Watches 17/2".

*Primary Examiner*—Edwin C. Holloway, III

*Attorney, Agent, or Firm*—Sughrue, Mion, Zinn, Macpeak & Seas

[57] ABSTRACT

A system applicable to a data display radio pager for displaying week-day and/or time by a plurality of elements or segments implemented by light emitting diodes (LEDs) or similar devices. Week-day is represented by two characters, i.e., the first character represented by ten elements or segments implemented by, for example, light emitting diodes (LEDs) and the second character following the first alphabet and represented by seven elements or segments which may also be implemented by LEDs. Regarding time, the tens digit of hours is represented by, for example, LEDs in the form of fixed numerals 1 and 2.

11 Claims, 8 Drawing Sheets

WEEK-DAY AND/OR TIME DISPLAY SYSTEM FOR A DATA DISPLAY RADIO PAGER

This is a continuation of application Ser. No. 07/827,391 filed Jan. 29, 1992, now abandoned.

BACKGROUND OF THE INVENTION

The present invention relates to a display system advantageously applicable to a data display radio pager for displaying week-day and/or time by a plurality of elements or segments which may be implemented by light emitting diodes (LEDs).

A display having elements or segments implemented by LEDs is conventional and usually has, for example, seven segments assigned to each of an array of alphanumeric characters. To display, week-day, for example, three discrete display units may be arranged in an array and have their segments selectively turned on to represent characters "MON", "TUE", "WED" and so forth. Alternatively, dots may be arranged in a matrix of more than 5×7 bits per character so as to generate alphabets representative of week-day. To display time, four display units each having seven segments of LEDs may be arranged in an array and turned on independently of one another. For example, time "ten twenty-five" may be displayed as "10:25".

The conventional systems displaying week-day by three characters and time by four numerals are not desirable since they assign one display unit to each alphanumeric character and turn on only necessary ones of them. Specifically, a substantial space has to be allocated to week-day and time on a display. This is a critical drawback when it comes to, among others, a data display radio pager or similar apparatus which is required to display a message and other necessary data on a miniature display thereof. Further, since week-day, for example, needs an array of at least three characters, the system assigning dots of 5×7 bits to each character is not practicable unless more than 105 bits are assigned to display a week-day. This scales up an IC for driving the display and, therefore, increases the overall cost of the apparatus.

SUMMARY OF THE INVENTION

It is, therefore, an object of the present invention to provide a week-day and/or time display system which reduces the area to be occupied by week-day and time on the display of an apparatus.

It is another object of the present invention to provide a week-day and/or time display system which optimizes the number of segments for representing week-day and time and thereby reduces the scale of an IC for driving a display.

In accordance with the present invention, a system for displaying week-days, or Sunday to Saturday, by a first character and a second character which follows the first character comprises first display having ten segments for representing the first character by ten or less segments, and a second display having seven segments for representing the second character by seven or less segments.

Also, in accordance with the present invention, a system for displaying time by hours and minutes comprises a first diplay having a single fixed segment in the form of a numeral "2" for representing the tens digit or hours, a second display having a single fixed segment in the form of a numeral "1" for representing the units digit of hours, a third display having seven segments for representing the tens digit of minutes, and a Fourth display having seven segments for representing the units digit Of minutes.

BRIEF DESCRIPTION OF THE DRAWINGS

The above and other objects, features and advantages of the present invention will become more apparent from the following detailed description taken with the accompanying drawings in which.

DESCRIPTION OF THE RPEFERRED EMBODIMENTS

Figure 1B:
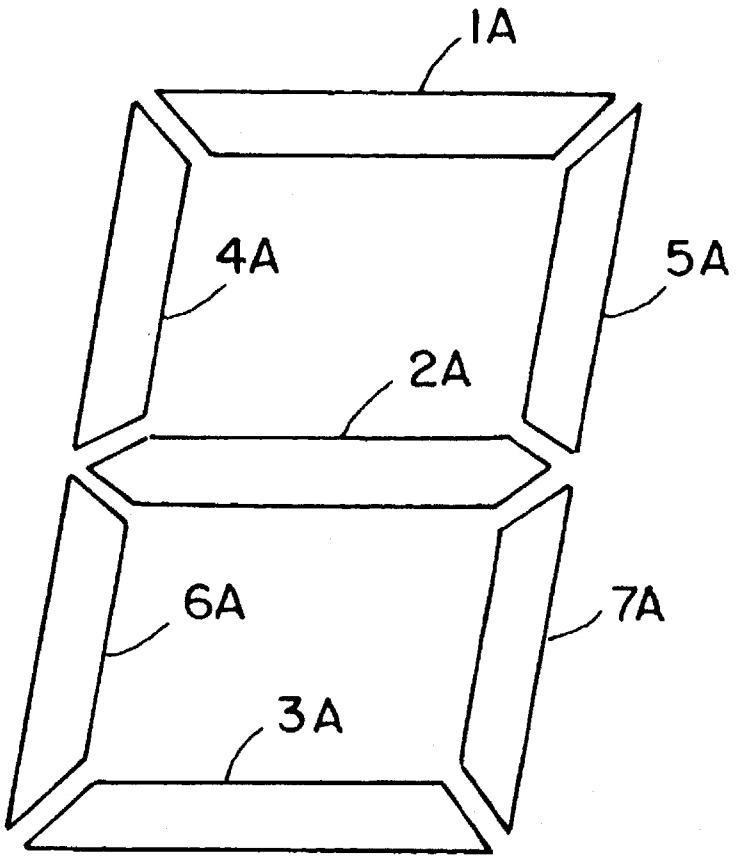
FIGS. 1A and 1B show a display system embodying the present invention and displaying week-day.
Figure 1A:
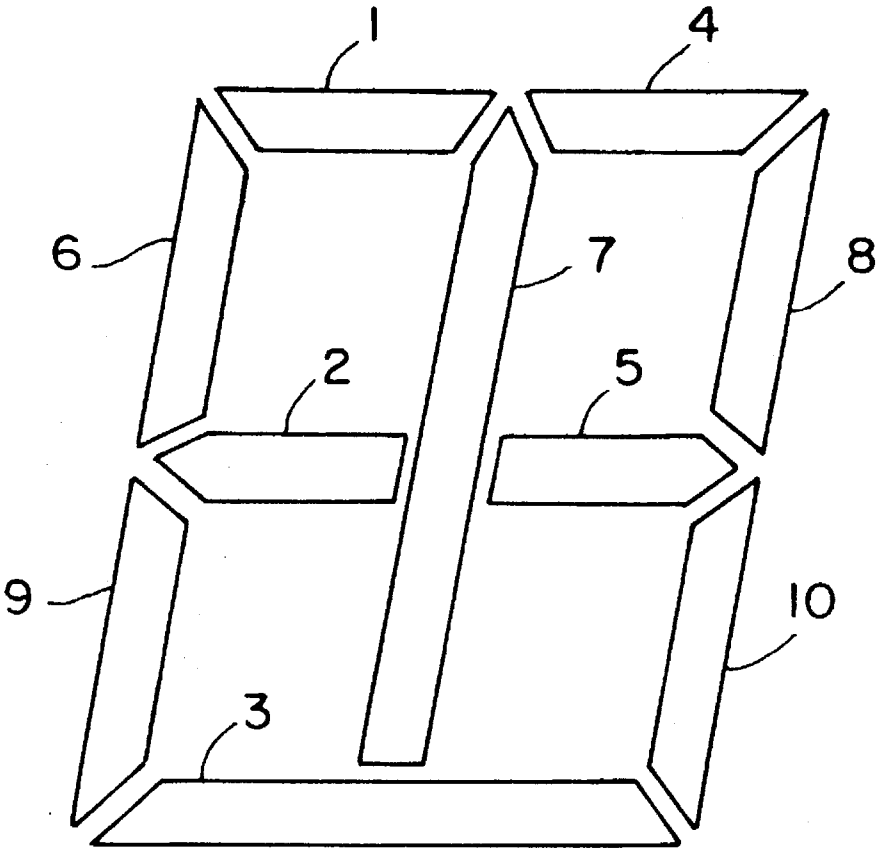
Figure 2A:
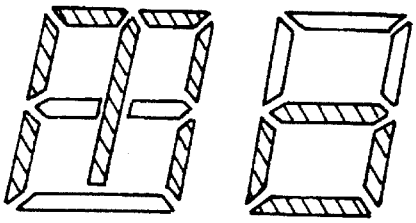
FIGS. 2A–2G show week-days displayed by the embodiment.
Figure 2B:
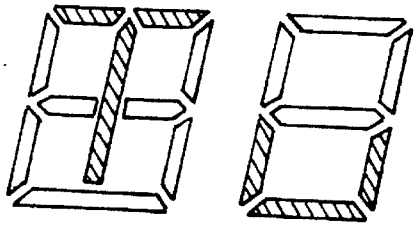
Figure 2C:
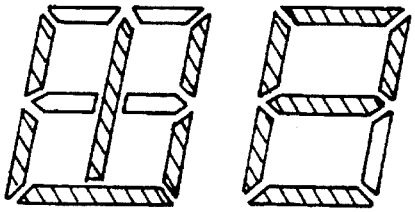
Figure 2D:
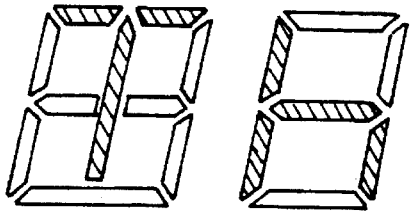
Figure 2E:
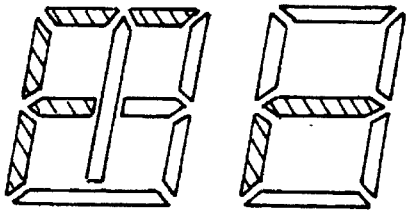
Figure 2F:
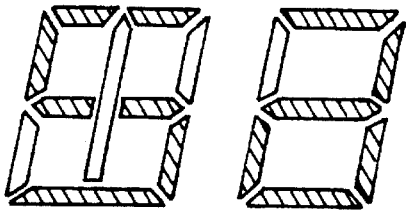
Figure 2G:
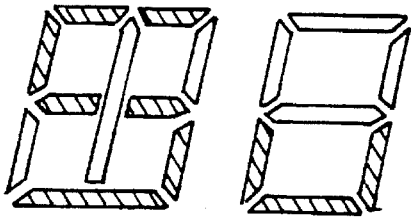

Referring to FIGS. 1A and 1B, a display system embodying the present invention is shown which displays week-day by two characters, i.e., "Mo" meaning Monday, "Tu" meaning Tuesday, "We" meaning Wendsday, "Th" meaning Thursday, "Fr" meaning Friday, "Sa" meaning Saturday, or "Su" meaning Sunday. As shown in FIG. 1A, ten elements or segments 1–10 are used to display the capital letter of each week-day and implemented by LEDs by way of example. As shown in FIG. 1B, ordinary seven elements or segments 1A–7A are used to display the small letter of each week-day and also implemented by LEDs by way of example. FIGS. 2A–2G show respectively "Mo", "Tu", "We", "Th", "Fr", "Sa" and "Su" each being represented by the two groups of segments 1–10 and 1A–7A. It will be appreciated from FIGS. 1A through FIG. 2G that all of the segments in the ten element and seven element displays are arranged either substantially horizontally or substantially vertically, i.e., each element is either substantially orthogonal or substantially parallel to all of the other elements. It will also be apparent that the ten (10) element display includes first elements defining a large parallelogram while second elements divide the large parallelogram into a number of included smaller parallelograms. In an exemplary case, four (4) small parallelograms are included within the large parallelogram. The seven (7) element display also forms a large parallelogram from several, e.g., two (2), smaller parallelograms. It should also be noted that all of the segments included in the ten (10) element display are located within the area defined by a quadrilateral, e.g., the large parallelogram.

Figure 3B:
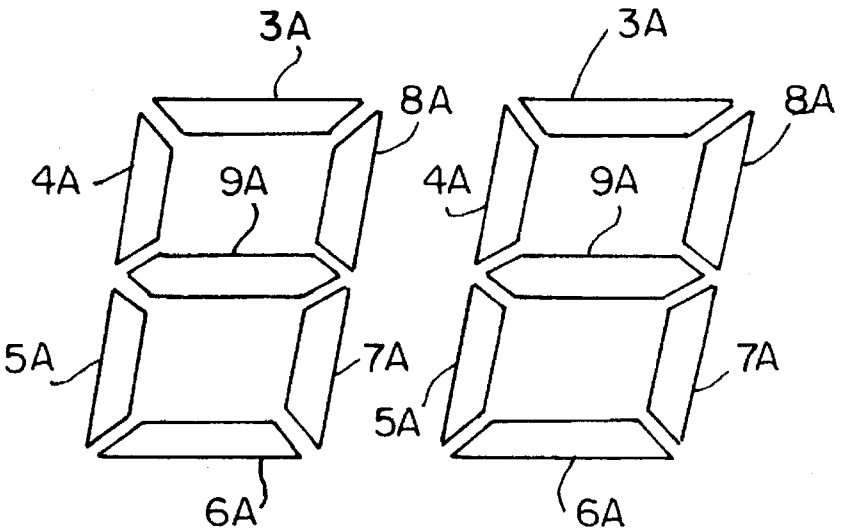
FIGS. 3A and 3B show an alternative embodiment of the present invention and displaying time.
Figure 3A:
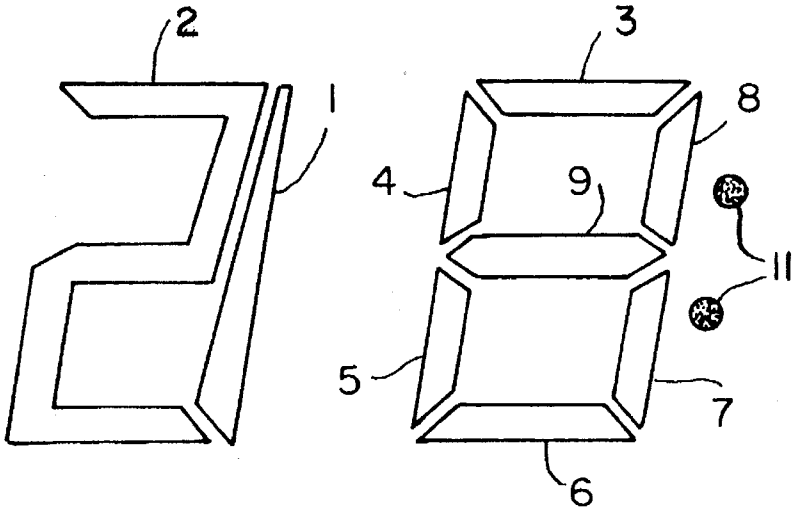

FIGS. 3A and 3B show an alternative embodiment of the present invention which displays time. As shown, the embodiment displays the time when a message has been received by hours and minutes. Generally, regarding hours 0–24, the tens digit may be either 1 or 2 while the units digit ranges from 0 to 9. Hence, as shown at the left-hand side in FIG. 3A, the tens digit has an element or segment 1 representative of "1" and an element or segment 2 representative of "2". These elements 1 and 2 may be implemented by LEDs. From 0.00 to 9.00, none of the elements 1 and 2 glows. More specifically, the elements 1 and 2 are fixed. As shown at the right-hand side in FIG. 3B, the units digit is represented by ordinary seven elements or segments 3–9. As shown in FIG. 3B, minutes 0–59 are represented by two juxtaposed numerals each being constituted by seven elements or segments 3A–9A. In FIG. 9A, the reference numeral 11 designates dots intervening between the hours and minutes for distinguishing them and flash at an interval of 0.5 seconds, i.e., a period of 1 second.

When the above-described system displaying week-day or the system displaying time is applied to a data display radio pager, it does not limit the display space to be allocated to data and, in addition, it noticeably reduces the number of ICs for driving LEDs or similar display elements.

Figure 4A:
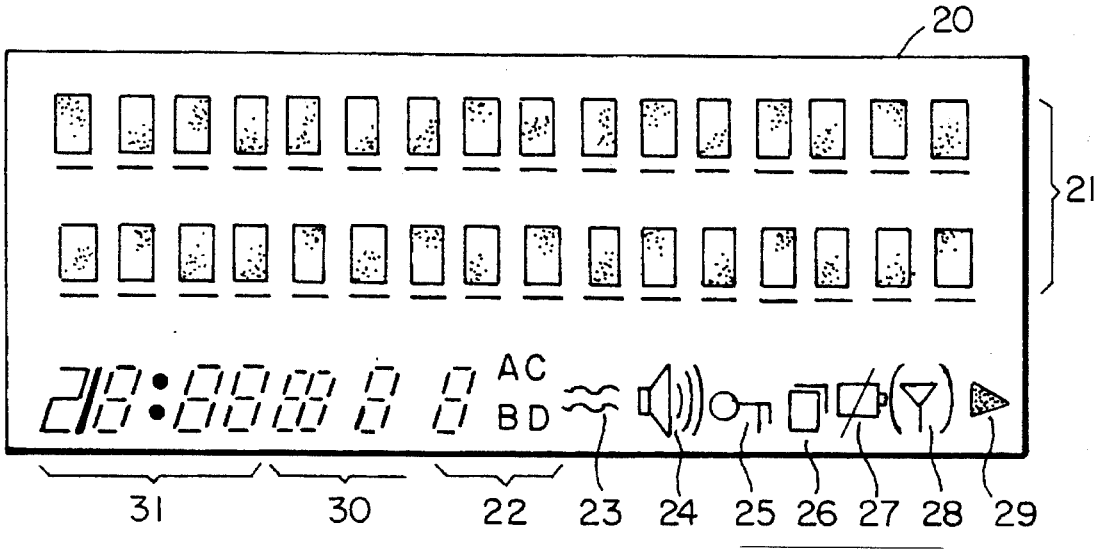
FIGS. 4A and 4B show a display provided on a data display radio pager to which the illustrative embodiments of the present invention are applied.
Figure 4B:
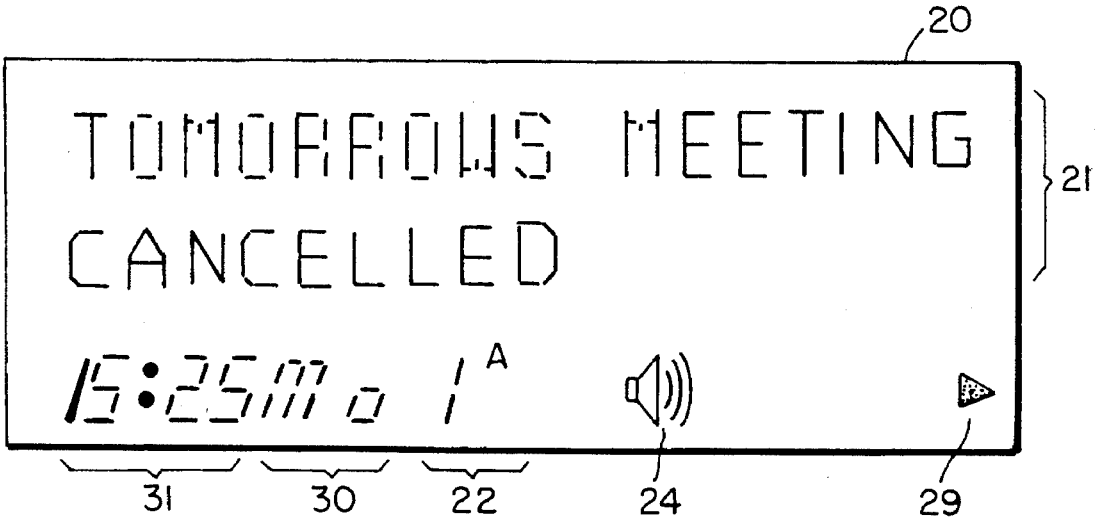

FIGS. 4A and 4B show a data display radio pager to which the present invention is applied. Specifically, FIG. 4A shows a display 20 in a condition wherein all the elements or segments are turned on. As shown, the display 20 includes a message display section 21, a received address display section 22, an alert display section 23 associated with vibration, an alert display section 24 associated with alert tone, a message protection display section 25, a message duplication display section 26, a low voltage display section 27, an out-of-area display section 28, and a message continued display section 29. In addition, the display 20 has a week-day display section, e.g., FIGS. 1A and 1B, 30 and a time display section, e.g., FIGS. 3A and 3B, 31. FIG. 4B shows a specific condition wherein a received message is displayed on the display 20.

Figure 5:
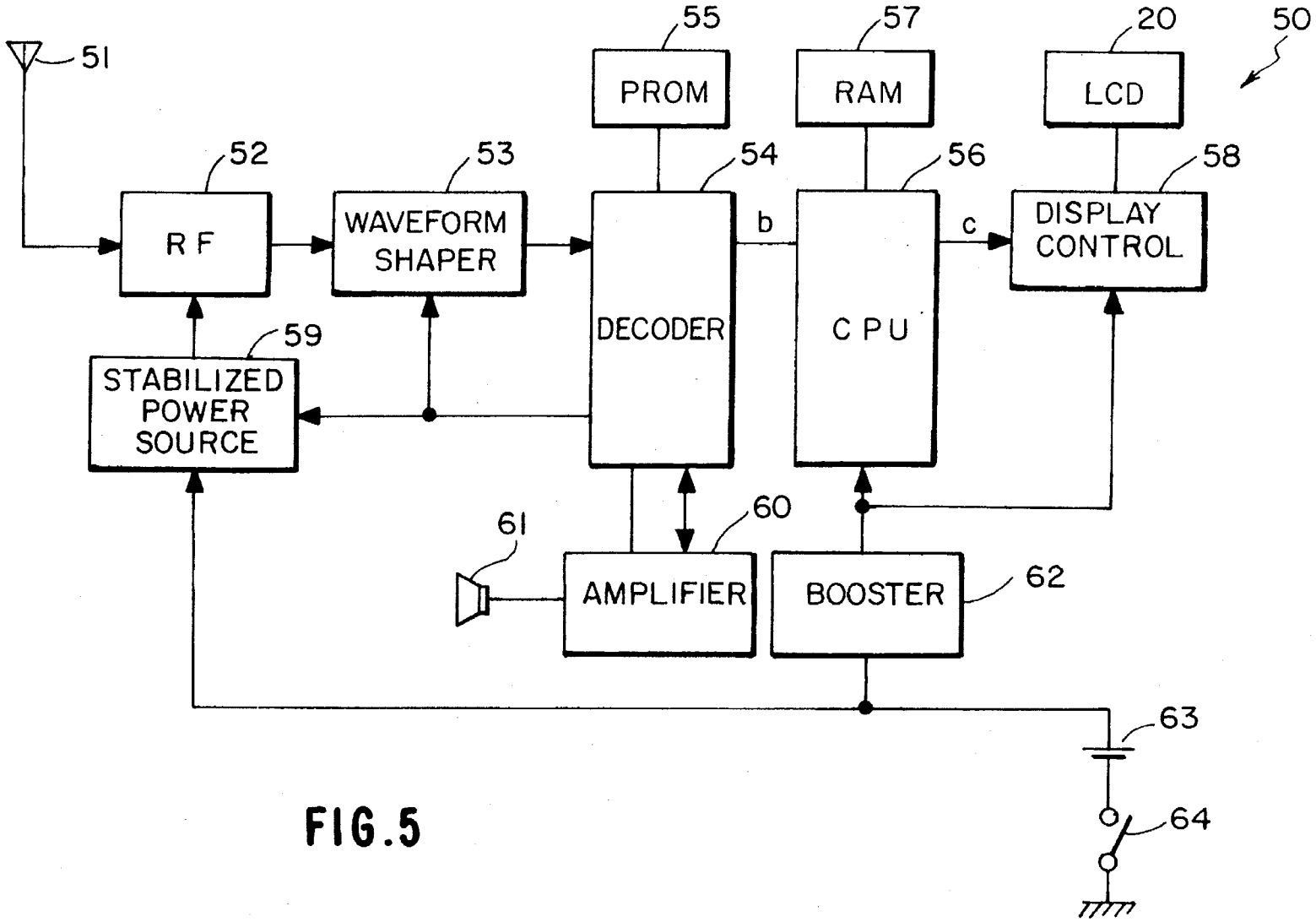
FIG. 5 is a block diagram schematically showing a specific construction of the radio pager.

A reference will be made to FIG. 5 for describing a specific construction of a data display radio pager to which the embodiments stated above are applicable. A shown, the pager, generally 50, has an antenna 51, an RF (Radio Frequency) section 52, a waveform shaper 53, a decoder 54, a PROM (Programmable Read Only Memory) 55 storing an address assigned to the pager, a CPU (Central Processing Unit) 56, a RAM (Random Access Memory) 57 for storing display data, a display control 58 for controlling the display 20, e.g., FIG. 4A, a stabilized power source 59, an amplifier 60 for amplifying a tone signal, a loudspeaker 61, a booster 62, a battery or similar power source 63, and a power switch 64.

Figure 6:
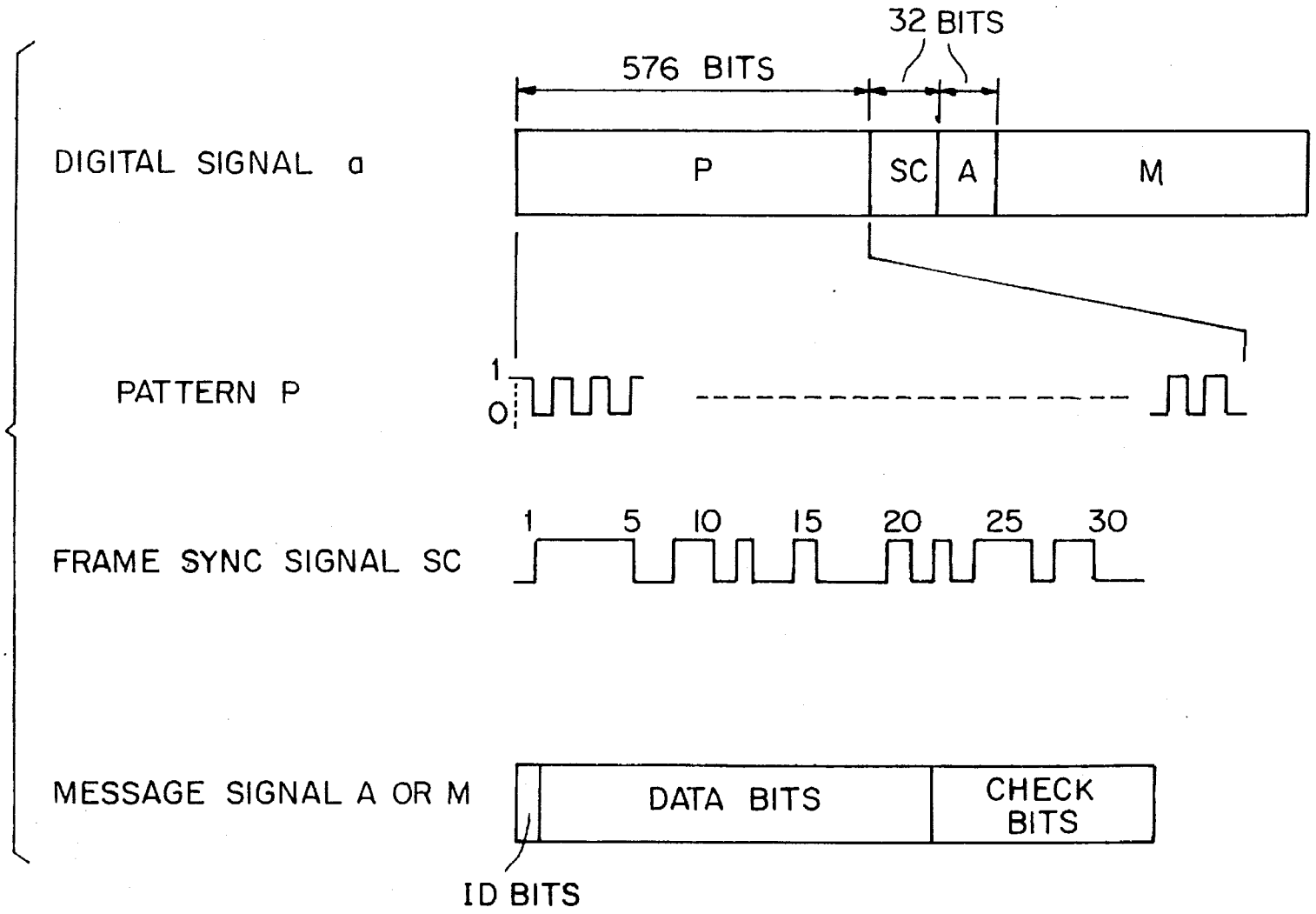
FIG. 6 shows the waveforms of signals useful for understanding the operation of the radio pager.

The operation of the pager 50 will be described with reference also made to FIG. 6. An RF signal coming in through the antenna 51 is received and demodulated by the RF section 52 and then processed by the waveform shaper 53 to become a digital signal α shown in FIG. 6. On receiving the digital signal α, the decoder 54 sets up bit synchronization by use of a repetitive pattern P of ONE and ZERO shown in FIG. 6 and then starts on the detection of a frame synchronizing signal SC which follows the pattern P. As the decoder 54 detects the frame synchronizing signal SC, it reads the assigned address out of the PROM 55 and determines whether or not u address signal A included in the digital signal a is coincident with the assigned address. If the two addresses are equal, the decoder 54 activates the CPU 56 via a signal line b to cause it to receive and decode a message signal M which follows the address signal A. Subsequently, the decoder 54 produces an alert tone via the amplifier 60 and loudspeaker 61 to inform the user of the pager 5 of the reception of a call. On the other hand, the CPU 56 delivers message data to the display control 58. In response, the display control 58 decodes character codes of the message data. As a result, the message data is displayed on the LCD 20 as a message.

Figure 7:
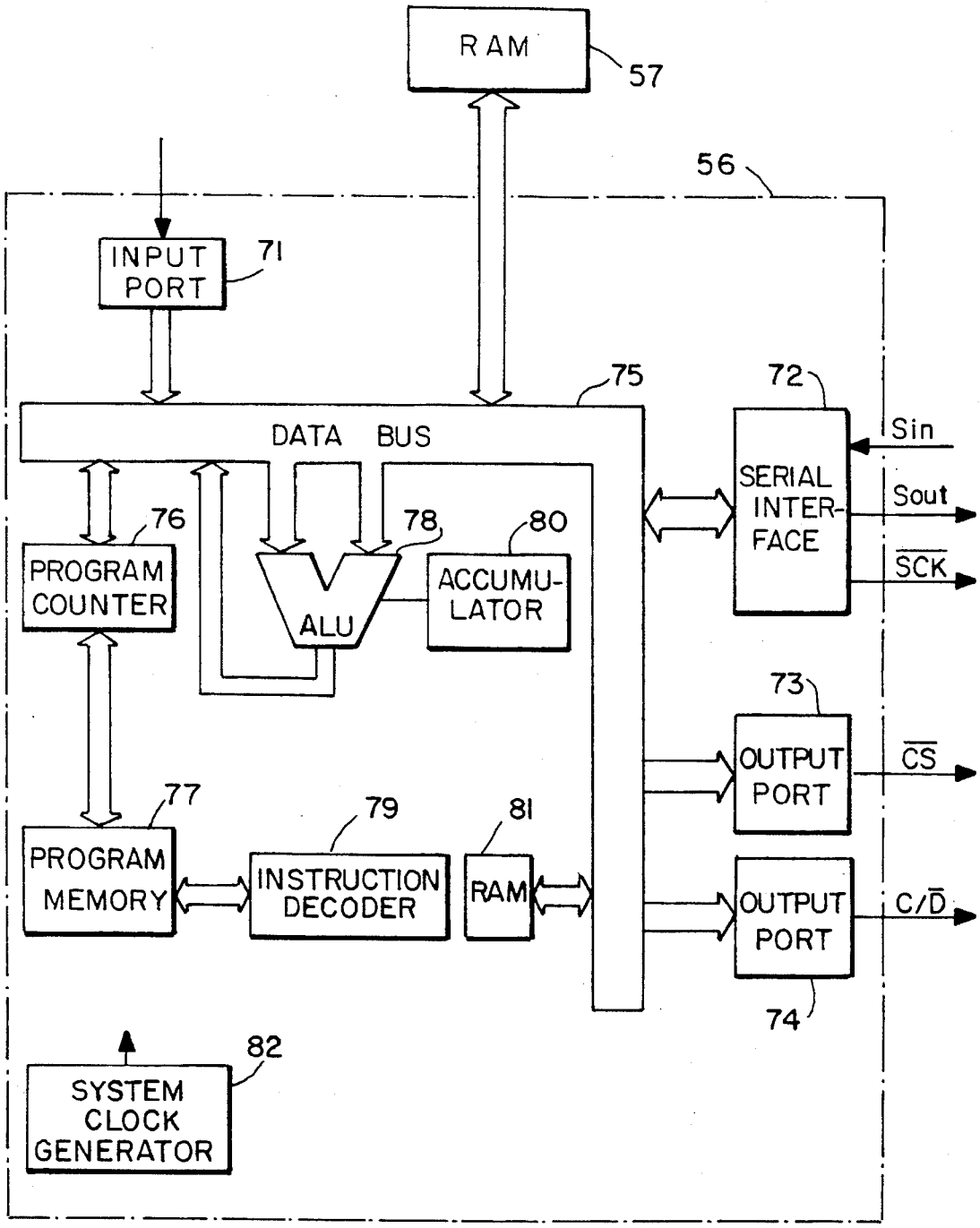
FIG. 7 is a block diagram schematically showing a specific construction of a CPU included in the radio pager.
Figure 8:
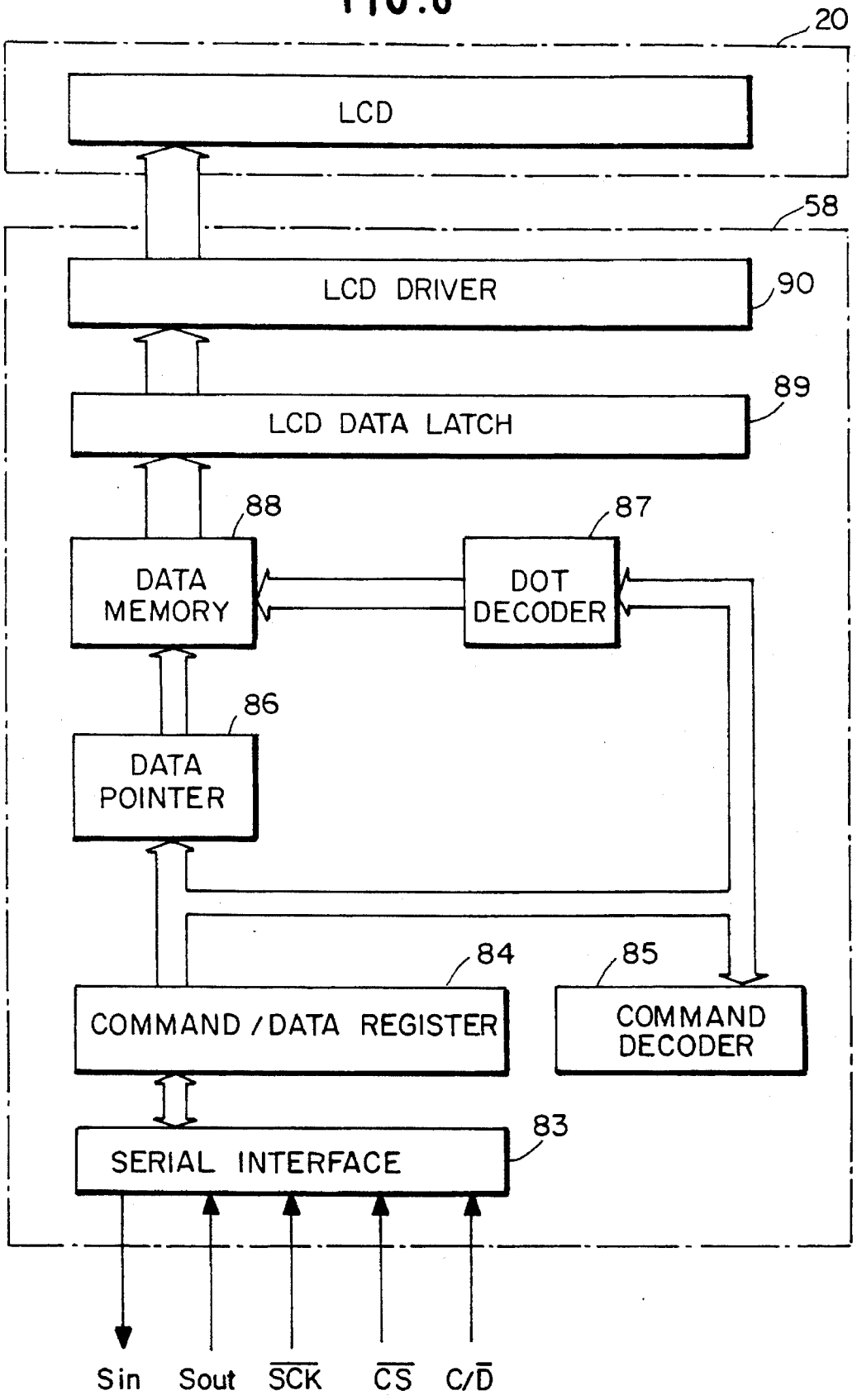
FIG. 8 is a block diagram schematically showing a specific construction of a display control also included in the radio pager.

Referring to FIGS. 7 and 8, the CPU 56 and display control 58 will be described more specifically. As shown in FIG. 7, the CPU 56 has an input port 71, a serial interface 72, output ports 73 and 74, a data bus 75, a program counter 76, a program memory 77 storing a sequence of commands to be executed and reading out the content of an address designated by the program counter 76, an ALU (Arithmetic and Logic Unit) 78 for performing various kinds of arithmetic and logical operations, an instruction ecoder 79 for decoding command information fed from the program memory 77 and delivering controls signals matching the command to various sections, an accumulator 80 for allowing the ports 71, 72, 73 and 74 to interchange data, a RAM 81 for storing various kinds of data, and a system clock generator 82 for determining the cycle time for executing commands. As shown in FIG. 8, the display control 58 has a serial interface 83, a command/data register 84, a command decoder 85, a data pointer 86, a dot decoder 87, a data memory 88, an LCD (Liquid Crystal Display) data latch 89, and an LCD driver 90.

Data is transferred from the CPU 55 to the display control 58, as follows. First, the CPU 56 changes a signal line $\overline{C}$ $\overline{S}$ from a high level to a low level to set up a data input mode. After the entry of data, the CPU 56 causes the signal line $\overline{CS}$ to go high to set up a data display mode. Subsequently, the CPU 56 sequentially transfers a command and data to the display control 58 over a signal line Sout at particular timings determined by a signal line $\overline{SCK}$. The CPU 56 changes a signal line $C/\overline{D}$ to a high level for a command or changes it to & low level for data, so that the display control 58 may distinguish a command and data. The serial interface 83 receives a serial signal from the CPU 56 and feeds it to the command/data register 84. On receiving a command, the command/data register 84 transfers the content thereof to the command decoder 85. The command decoder 85 decodes the command and controls the command/data register 84, data pointer 85 and dot decoder 87 in matching relation to the command. On receiving data, the command/data register 84 transfers the data to the dot decoder 87. The dot decoder 87 converts the input data to display data to be displayed on the LCD 20. The display data from the dot decoder 87 is written to the data memory 88 and applied to the LCD driver 90 via the LCD data latch 89. The LCD driver 90 displays a message on the LCD 20 on the basis of the display data fed thereto from the data memory 88.

In summary, it will be seen that the present invention provides a display system for a data display radio pager or similar apparatus which is capable of displaying week-day by two characters, i.e., by ten elements or segments representative of a capital letter and seven elements or segments representative of a small letter located next to the capital letter. Hence, an apparatus implemented with the present invention has only to allocate a small area to week-day on a display thereof. In addition, since the number of segments is optimal, an IC for driving the display can be scaled down. The display system is also capable of displaying time and, to display the tens digit of hours, uses only two fixed elements representative of numerals "1" and "2". This is successful in noticeably scaling down the IC for driving the display, compared to a dot type drive IC.

Various modifications will become possible for those skilled in the art after receiving the teachings of the present disclosure without departing from the scope thereof.

What is claimed is:

1. A device for displaying week-days, or Sunday to Saturday, by a first character and a second character which follows said first character, comprising:

first display means having ten linear segments, each of said ten linear segments being disposed either substantially parallel to or orthogonally with respect to each of all others of said ten linear segments, for representing said first character by ten segments, wherein a predetermined first number of said ten linear segments defines a first parallelogram, wherein a predetermined second number of said ten linear segments divides said first parallelogram into second through fifth parallelograms, wherein the sum of said first and said second numbers is ten (10), and wherein one of second number of said ten linear segments is common to all of said second through said fifth parallelograms; and second display means having seven segments, each of said seven segments being disposed either substantially parallel to or orthogonally to with respect to all other said seven segments, for representing said second character by seven or less segments.

2. A device as claimed in claim 1, wherein said first display means comprises ten LEDs each constituting a respective one of said ten linear segments, said second display means comprising seven LEDs each constituting respective one of said seven segments.

3. A device for displaying week-days, or Sunday to Saturday, by a first character and a second character which follows said first character, as claimed in claim 1, wherein a predetermined number of said ten linear segments included in said first display means defines a quadrilateral, and wherein all of said ten linear segments are located within the respective area of said quadrilateral.

4. A device for displaying week-days, or Sunday to Saturday, by a first character and a second character which follows said first character, as claimed in claim 1, wherein all seventeen of respective segments included in said first and said second display means are disposed either substantially parallel to or orthogonally with respect to all other said respective segments in said each of said first and said second display means.

5. A device for displaying week-days, or Sunday to Saturday, by a first character and a second character which follows said first character, as claimed in claim 1, wherein a predetermined third number of said seven segments in said second display means defines a sixth parallelogram, wherein a predetermined fourth number of said seven segments divides said sixth parallelogram into seventh and eighth parallelograms, and wherein the sum of said third and said fourth numbers is seven (7).

6. A device for displaying week-days, or Sunday to Saturday, by a first character and a second character which follows said first character, as claimed in claim 1, wherein said second number of said ten linear segments in said first display means is equal to three (3).

7. A device for displaying week-days, or Sunday to Saturday, by a first character and a second character which follows said first character, as claimed in claim 1, wherein said first number of said ten linear segments in said first display means is equal to seven (7).

8. A device for displaying week-days, or Sunday to Saturday, and time by hours and minutes, comprising:

first display means having ten linear segments, each of said ten linear segments being disposed one of substantially vertically and horizontally, for representing a first one of two characters representative of week-day by ten or less segments, wherein a predetermined first number of said ten linear segments defines a first parallelogram, wherein a predetermined second number of said ten linear segments divide said first parallelogram into second through fifth Parallelograms, and wherein said first number of said ten linear segments is equal to seven (7);

second display means having seven segments, each of said seven segments being disposed one of substantially vertically and horizontally, for representing a second one of said two characters by seven or less segments;

third display means having a single fixed segment in the form of a numeral "2" and a single fixed segment in the form of a numeral "1" for representing the tens digit of hours;

fourth display means having seven segments for representing the units digit of hours;

fifth display means having seven segments for representing the tens digit of minutes; and sixth display means having seven segments for representing the units digit of minutes.

9. A device for displaying week-days, or Sunday to Saturday, and time by hours and minutes, as claimed in claim 8, wherein a predetermined number of said ten linear segments included in said first display means define a quadrilateral, and wherein all of said ten linear segments are located within the respective area of said quadrilateral.

10. A device for displaying week-days, or Sunday to Saturday, and time by hours and minutes, as claimed in claim 8, wherein a predetermined third number of said seven segments included in said second display means defines a sixth parallelogram and wherein a predetermined fourth number of said seven segments divide said sixth parallelogram into seventh and eighth parallelograms.

11. A device for displaying week-days, or Sunday to Saturday, and time by hours and minutes, as claimed in claim 8, wherein said second number of said ten linear segments is equal to three (3).

* * * * *